US005882225A

United States Patent [19]

Kee et al.

[11] Patent Number: 5,882,225

[45] Date of Patent: Mar. 16, 1999

[54] JACK CONNECTOR DEVICE

[75] Inventors: Eric Chan Wei Kee; Kan Meng Kuang, both of Singapore, Singapore

[73] Assignee: Berg Technology, Inc., Reno, Nev.

[21] Appl. No.: 768,654

[22] Filed: Dec. 18, 1996

Related U.S. Application Data

[63] Continuation-in-part of Ser. No. 381,896, Feb. 8, 1995, abandoned.

[51] Int. Cl.[6] ..... H01R 13/518

[52] U.S. Cl. ..... 439/540.1

[58] Field of Search ..... 439/540.1, 541.5, 439/532, 701, 686, 695

[56] References Cited

U.S. PATENT DOCUMENTS

| | | | |
|---|---|---|---|
| 4,392,701 | 7/1983 | Weidler | 339/17 R |
| 4,595,799 | 6/1986 | Krob et al. | 179/98 |
| 4,596,436 | 6/1986 | Kraemer et al. | 439/701 |
| 4,641,900 | 2/1987 | Japngie | 339/17 LC |
| 4,734,043 | 3/1988 | Emert et al. | 439/65 |
| 4,767,338 | 8/1988 | Dennis et al. | 439/55 |
| 5,131,866 | 7/1992 | Bodenweiser et al. | 439/532 |
| 5,161,997 | 11/1992 | Defibaugh et al. | 439/540.1 |
| 5,314,357 | 5/1994 | Weidler | 439/701 |

FOREIGN PATENT DOCUMENTS

| | | |
|---|---|---|
| PCT/US83/00456 | 10/1983 | WIPO . |

*Primary Examiner*—Gary F. Paumen

*Attorney, Agent, or Firm*—Woodcock Washburn Kurtz Mackiewicz & Norris LLP

[57] ABSTRACT

A jack connector device for placing a plurality of jack connectors on a printed circuit board is disclosed. The connector device comprises an elongated, insulating housing having individual receptacles for receiving socket sections. The receptacles are located in a single array at predetermined, non-contiguous locations along the length of the housing. The housing includes a first piece defining the receptacles and a second detachable piece that holds the socket sections securely in place along the length of the housing.

6 Claims, 2 Drawing Sheets

JACK CONNECTOR DEVICE

This is a continuation-in-part of application Ser. No. 08/381,896, filed Feb. 8, 1995, now abandoned.

BACKGROUND OF THE INVENTION

1. Field of the Invention

The present invention relates to a jack connector device and, in particular, to a jack connector device which connects a plurality of jack connectors to a printed circuit board.

2. Description of the Related Art

A modular jack connector is a printed circuit board mount type connector and is used to connect a cable which is run from outside a communications unit for instance to a printed circuit board present within the communications unit. In recent years, this type of connector has been employed not only for communications units but also for the interface, etc., of an office automation unit and peripheral units.

Such connectors are each employed to receive those modular jacks in a single cable and, in order to correspond to the number of cables to be connected to the printed circuit board, a plurality of connectors are mounted on that printed circuit board.

This type of connector is usually of a compact type and a time consuming operation is required in mounting a larger number of such connectors on the printed circuit board. Readier mounting of the connectors is, therefore, required.

Existing jack connector devices have socket sections, provided for receiving the modular jacks, that are fixed in the device and are not readily removable.

A connector device that provides for easier placement and removal of socket sections is, therefore, required to aid in easier assembly, disassembly, mounting and maintenance.

In addition, existing jack connector devices require relatively complicated manufacturing processes to create the receptacles for the socket sections and/or to secure them in place on the connector device. Connectors without these complex receptacle features, that are relatively simple to manufacture are, therefore, desired.

SUMMARY OF THE INVENTION

According to one aspect of the present invention, a jack connector device for placing a plurality of jack connectors on a printed circuit board includes an elongated, insulating housing having individual receptacles for receiving socket sections, the receptacles being located in a single array at predetermined, noncontiguous locations along the length of the housing. The housing includes a first piece having a rear wall, two side walls located at the ends of the rear wall at right angles, and a plurality of separating members located between the ends extending from the rear wall in the same direction as the side walls. The housing also includes a second detachable piece mounted opposite said rear wall, having a plurality of holes for receiving the separating members and two cut-out sections for receiving the side walls. The side walls latch the second detachable piece in place, whereby said front wall holds the socket sections at secure positions along the length of the housing between the side walls.

According to a second aspect of the present invention, a jack connector device for placing a plurality of jack connectors on a printed circuit board has an elongated insulating housing having individual receptacles for receiving socket sections. The receptacles being located in a single array at predetermined, non-contiguous locations along the length of the housing. The housing includes: a first piece having a rear wall, two side walls located at the ends of the rear wall at right angles, and a plurality of separating members located between the ends extending from the rear wall in the same direction as the side walls; and a second detachable piece mounted opposite the rear wall, having a plurality of holes for receiving the separating members and two cut-out sections for receiving the side walls, the side walls latching the second detachable piece in place; whereby the front wall holds the socket sections at secure positions along the length of the housing between the side walls, the socket sections having mounting legs for anchoring the socket sections to a printed circuit board.

DETAILED DESCRIPTION OF THE PREFERRED EMBODIMENT

Figure 1:
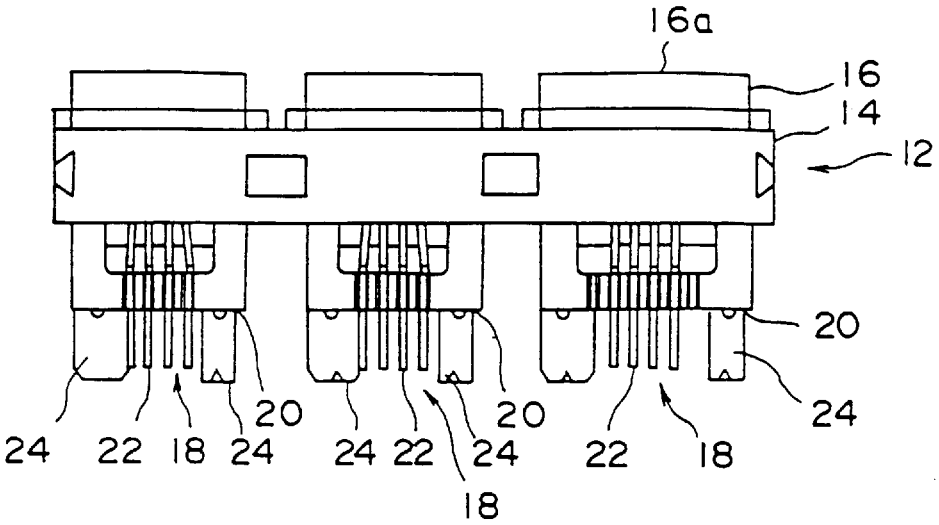
FIG. 1 is a front view showing a jack connector device according to an embodiment of the present invention.
Figure 2:
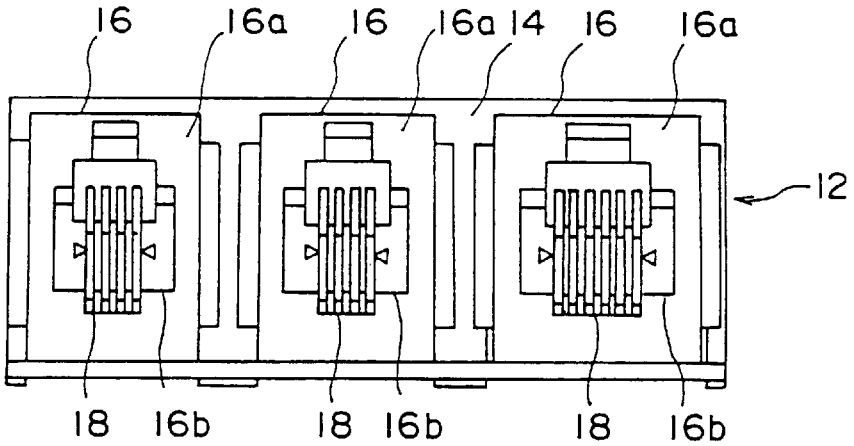
FIG. 2 is a top view showing the jack connector device of FIG. 1 as viewed in a direction in which modular jacks are received.

FIGS. 1 to 4 show a jack connector device according to an embodiment of the present invention. The jack connector device 12 has an elongated housing or holder 14 which is molded.

The housing 14, having a generally rectangular shape, comprises two parts. One part comprises a rear wall 14*c*, two side walls 14*d* and 14*e* and a plurality (2 in Figures) of separating members 14*b*. The rear wall 14*c* serves as the length of the housing 14 and the two side walls 14*d* and 14*e* complete right angles at the ends of the rear wall 14*c*. The separating members 14*b* extend from the rear wall 14*c*. The other part comprises a front wall or a second detachable piece 14*a*, that completes the rectangular shape of the housing 14.

A plurality of socket sections 16 are provided in a single array in the housing such that they extend along a length of the housing. The separating members 14*b* serve to provide individual receptacles for each socket section 16. Prior to insertion of the front wall 14*a* of the housing 14, the socket sections 16 are placed non-contiguously between the side walls 14*d* and 14*e* of the housing and the separating members 14*b* or between consecutive separating members 14*b*. No two socket sections 16 are positioned in direct contact with one another.

Contact terminals 18 are arranged below the respective socket sections such that their lower end portions extend, as solder tails 22, from the corresponding lower end surfaces of the respective socket sections 16. The solder tails 22 are inserted into corresponding through holes in an associated printed circuit board (PCB), not shown, and soldering is effected there by, for example, an infrared soldering reflow step to electrically connect the contact terminals 18 to a circuit pattern on the PCB.

Figure 3:
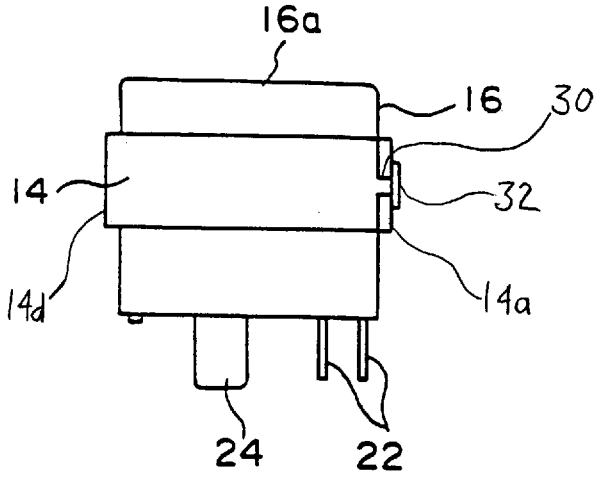
FIG. 3 is a side view showing the jack connector device of FIG. 1.
Figure 4:
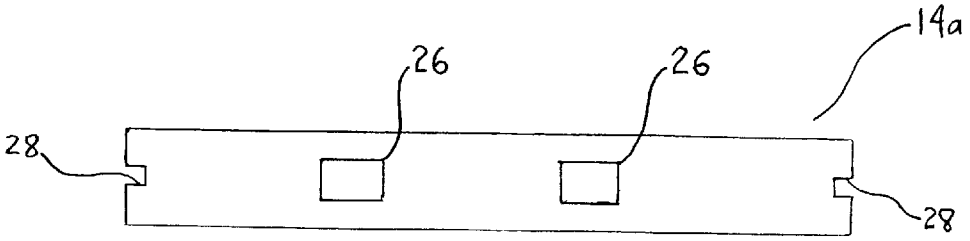
FIG. 4 is a front view of the second detachable piece of the housing of the jack connector device of FIG. 1.

Assembly of the jack connector device 12 is accomplished by first, placing socket sections 16 in the individual receptacles in the housing 14. The detachable front wall 14*a* receives the ends of the separating members 14*b* opposite the rear wall 14*c* of the housing 14 by means of holes 26 of rectangular shape. The front wall 14*a*, having cut-out sections 28 of rectangular shape, is then set in place by fitting these cut-out sections 28 onto grooves 30 around relatively small extensions on the ends of both side walls 14*d* and 14*e* of the housing 14 opposite the rear wall 14*c*. As shown in FIG. 3, the front wall is latched into place (as well as detached) by means of the extensions of trapezoidal shape 28 at the far ends of the side walls 14*d* and 14*e* opposite the rear wall 14*c*. The socket sections 16 are now secured in place in the jack connector device 12.

A known modular jack, not shown, is inserted into an opening 16*b* in a top end 16*a* of a respective socket section 16 and hence secured in the socket section 16.

The modular jack, upon being inserted into the socket section, is brought into contact with the contact terminals so that the jack is electrically connected by the contact terminals 18 to the circuit pattern on the PCB. The respective socket section 16 correspond to one modular jack connector.

Mount legs 24 extend from the lower surface 20 of the socket section 16. The mount legs 24 are inserted into associated mount holes in the PCB and fixed there, whereby the jack connector device 12 is mounted on the PCB. A housing material, if being properly selected, can not only protect the housing 14 from high temperature due to the soldering of the solder tails 22 by, for example, the infrared soldering reflow step but also maintain a hermetic sealing property. For example, a metal such as aluminum as well as a thermoplastic resin such as hot nylon and polyphenylene sulfide (PPS) is preferable, as the housing material, depending upon the use to which the material is put.

According to the jack connector device 12, the housing 14 is mounted on the PCB by a single step only, thus performing the same function as mounting a plurality of modular jack connectors on the PCB.

Thus a mounting step preceding a soldering step is further simplified than the method for mounting respective independent modular jack connectors on the PCB either manually or by a robot.

Because of the simplicity of the design of the present invention, the housing 14 is easily molded at a low cost and hence the jack connector device 12 is manufactured at a low cost. The simplicity of the connector device 12 also provides for easier placement and removal of socket sections 16. Only one readily removable piece, i.e., the front wall 14*a* of the housing 14, serves to secure or release the socket sections from the connector device 12. Placement or removal of the socket sections 16 is particularly easy because the socket sections 16 have their own individual receptacles. Placement or removal of one socket section 16 will not interfere with neighboring ones. Thus, the design of the jack connector device 12, will provide for easier assembly, disassembly, mounting and maintenance.

The number of modular jacks mountable on the jack connector device 12 is shown as being three but not restricted thereto. By setting any proper number of socket sections 16 in the housing 14, it is possible to readily cope with a different number of modular jacks and/or socket sections 16 as a single unit.

It is also possible to combine connector devices by connecting the housing 14 of one jack connector device 12 with the housing 14 of another. A plurality of jack connector devices 12 is joined, by any means known in the art, end to end by joining the side walls 14*d* and 14*e* of a housing 14 with the side walls 14*d* and 14*e* of a housing 14 of another jack connector device 12. It is also possible for two devices 12 to be joined at their respective rear walls 14*c*, so that they would be aligned back to back.

Combining jack connector devices 12 in this manner, by joining them either end to end or back to back, will allow one to cope with an even greater number of modular jacks. In addition, combining jack connector devices 12 as well as individual jacks into a single unit will provide for readier mounting of a large number of jacks onto a PCB.

A combination of socket sections 16, that is, modular jack connectors, in the jack connector device 12 also has any combination of differently wired connectors, for example, 4, 6, or 8 wire connectors.

According to the preferred embodiment of the jack connector device of the present invention, since a plurality of jack connectors are mounted in a single housing at a time, the mounting step is readily carried out and the jack connectors are easily secured in one step. It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A jack connector device for placing a plurality of jack connectors on a printed circuit board, comprising an elongated, insulating housing having individual receptacles for receiving the jack connectors, said receptacles being located in a single array at predetermined, non-contiguous locations along the length of said housing, said housing comprising:

a first piece having a rear wall, two side walls located at the ends of said rear wall at right angles, and a plurality of separating members located between said ends extending from said rear wall in the same direction as said side walls; and a second detachable piece mounted opposite said rear wall, having a plurality of holes for receiving said separating members and two cut-out sections for receiving said side walls, said side walls latching said second detachable piece in place, whereby said front wall holds the jack connectors at secure positions along the length of said housing between said side walls.

2. The jack connector device according to claim 1 wherein said jack connectors are secured in said receptacles.

3. The jack connector device according to claim 1 wherein said holes of said second detachable piece for receiving said separating members are of different dimensions and are relatively larger than said cut-out sections for receiving said side walls.

4. The jack connector device according to claim 1 wherein said second detachable piece has holes of rectangular shape for receiving said separating members.

5. The jack connector device according to claim 1 wherein said side walls latch said second detachable piece by means of extensions at the far ends of said side walls opposite said rear wall.

6. A jack connector device for placing a plurality of jack connectors on a printed circuit board, comprising an elongated, insulating housing having individual receptacles for receiving the jack connectors, said receptacles being located in a single array at predetermined, non-contiguous locations along the length of said housing, said housing comprising:

a first piece having a rear wall, two side walls located at the ends of said rear wall at right angles, and a plurality of separating members located between said ends extending from said rear wall in the same direction as said side walls; and a second detachable piece mounted opposite said rear wall, having a plurality of holes for receiving said separating members and two cut-out sections for receiving said side walls, said side walls latching said second detachable piece in place;

whereby said front wall holds the jack connectors at secure positions along the length of said housing between said side walls, said socket sections having mounting legs for anchoring said socket sections to a printed circuit board.

* * * * *